US006390554B1

(12) United States Patent
Eakins et al.

(10) Patent No.: US 6,390,554 B1
(45) Date of Patent: May 21, 2002

(54) WEIGHT POSITIONING RECLINING SEAT KIT FOR WHEELCHAIRS

(75) Inventors: Richard Eakins; David Harding; Son Ma, all of Toronto (CA)

(73) Assignee: 1239907 Ontario Limited, Concord (CA)

( * ) Notice: Subject to any disclaimer, the term of this patent is extended or adjusted under 35 U.S.C. 154(b) by 0 days.

(21) Appl. No.: 09/635,790

(22) Filed: Aug. 11, 2000

Related U.S. Application Data

(63) Continuation-in-part of application No. 09/484,258, filed on Jan. 18, 2000.

(30) Foreign Application Priority Data

Nov. 23, 1999 (CA) ..... 2290145

(51) Int. Cl.[7] ..... A47C 3/00

(52) U.S. Cl. ..... 297/317; 297/341; 297/342; 297/65

(58) Field of Search ..... 297/317, 341, 297/342, 65, DIG. 4; 280/250.1; 180/907

(56) References Cited

U.S. PATENT DOCUMENTS

| | | | | |
|---|---|---|---|---|
| 2,859,797 A | * | 11/1958 | Mitchelson | 155/5 |
| 3,179,466 A | | 4/1965 | Garrett | 297/88 |
| 3,913,152 A | * | 10/1975 | Quakenbush | 5/37 |
| 4,274,503 A | | 6/1981 | Mackintosh | 180/23 |
| 4,346,933 A | | 8/1982 | Jacobs | 297/89 |
| 4,591,182 A | | 5/1986 | Wood | 280/647 |
| 4,655,471 A | * | 4/1987 | Peek | 280/242 |
| 4,759,561 A | | 7/1988 | Janssen | 280/242 |
| 4,787,674 A | * | 11/1988 | Inaba et al. | 297/317 |
| 4,834,411 A | | 5/1989 | Willey et al. | 280/250.1 |
| 4,945,582 A | | 8/1990 | Hayton et al. | 5/67 |
| 5,011,175 A | | 4/1991 | Nicholson et al. | 280/304.1 |
| 5,044,647 A | | 9/1991 | Patterson | 280/250.1 |
| 5,050,899 A | | 9/1991 | Stensby | 280/250.1 |
| 5,064,211 A | | 11/1991 | Huttenhuis et al. | 280/250.1 |
| 5,108,148 A | | 4/1992 | Henke | 292/81 |
| 5,123,495 A | | 6/1992 | Littlejohn et al. | 180/9.32 |
| 5,154,438 A | | 10/1992 | Barclay | 280/250.1 |
| 5,312,153 A | | 5/1994 | Lin | 297/89 |
| 5,333,887 A | | 8/1994 | Luther | 280/250.1 |
| 5,556,157 A | * | 9/1996 | Wempe | 297/68 |
| 5,803,545 A | | 9/1998 | Guguin | 297/316 |
| 5,853,059 A | | 12/1998 | Goertzen et al. | 180/65.6 |
| 5,944,131 A | | 8/1999 | Schaffner et al. | 180/65.1 |
| 5,971,482 A | | 10/1999 | Goertzen et al. | 297/329 |
| 6,086,154 A | * | 7/2000 | Mathey et al. | 297/341 |
| 6,089,593 A | | 7/2000 | Hanson et al. | 280/650 |
| 6,105,706 A | | 8/2000 | Cooper | 180/282 |
| 6,158,810 A | * | 12/2000 | Galloway | 297/354.1 |
| 6,254,188 B1 | * | 7/2001 | Downey | 297/341 |

FOREIGN PATENT DOCUMENTS

| | | | |
|---|---|---|---|
| GB | 2101884 | 1/1983 | A16G/5/00 |
| GB | 2136742 | 9/1984 | A16G/5/00 |

* cited by examiner

*Primary Examiner*—J. J. Swann
*Assistant Examiner*—J. Allen Shriver
(74) *Attorney, Agent, or Firm*—Piasetzki & Nenniger

(57) ABSTRACT

A kit for adding a reclining seat to a wheelchair, comprising a stationary seat frame for mounting to a base frame of the wheelchair, a seat for mounting to the stationary seat frame, the seat having a seat portion and a back portion pivotally mounted to said seat portion, and an actuator mounted on the seat for causing the back portion of said seat to change angle relative to said stationary seat frame, a sliding connector for slidably mounting said seat portion to said stationary seat frame, and means for sliding said seat on said stationary seat frame along said sliding connector without changing height as the actuator causes the angle of the back portion to change, wherein said kit, when mounted on a wheelchair, compensates for a change in an occupant's center of gravity by sliding said seat portion on said stationary seat frame as said back portion changes angle.

17 Claims, 4 Drawing Sheets

WEIGHT POSITIONING RECLINING SEAT KIT FOR WHEELCHAIRS

This is a continuation-in-part of application Ser. No. 09/484,258 filed Jan. 18, 2000.

FIELD OF THE INVENTION

This invention relates generally to the field of wheelchairs and more particularly to wheelchairs which include adjustable seats to allow the wheelchair occupant to change: position when seated on the wheelchair.

BACKGROUND OF THE INVENTION

Wheelchairs have been known and used for many years to assist disabled people in moving about. Wheelchairs are comprised of two main components, the mobile platform, which includes the base and wheels, and the seat, which is mounted to the base. In some cases the disabled people may have a problem with one or both legs; in other cases they may have even more serious problems which prevent other limbs from functioning in a coordinated manner. More recently, powered wheelchairs have been developed which include electrically powered drive motors adjacent to the main wheels of the wheelchair. These are particularly helpful to more seriously handicapped people. Typically such drive motors are powered by one or more batteries carried in the lower carriage or platform of the wheelchair.

In the past, the standard design of a wheelchair included large rear wheels and smaller front wheels. This design placed the rims of the rear wheels adjacent to the user's hands so that hand propulsion was feasible. However, these wheelchair platforms when motorized suffer a disadvantage in that they are not as manoeuvrable as desired. Therefore, more recently power wheelchair platforms have been developed which involve a central or mid-drive wheel, one or more rear pivoting wheels, and front anti-tip idler wheels which generally ride above the ground. An example of this type of wheelchair is produced by Pride Health Care Inc. and is illustrated in U.S. Pat. No. 5,944,131. The stated advantage of this wheelchair platform design is the greater degree of manoeuverability over conventional platforms since the drive wheels are located directly under the occupant at about the middle of the wheelchair. This location of the drive wheels means the turning radius is extremely small because in essence a shorter wheel base is provided. This makes the wheelchair platform more manoeuvrable and easier to get around corners in hallways, through doorways, and the like.

Wheelchair occupants tend to be seated on their wheelchairs for extended periods of time. No matter how carefully the seat and seat cushions are designed, it is still necessary for the occupant to change position from time to time to release pressure on areas at risk of developing pressure sores and to redistribute pressure. Therefore, it has been common to provide seats which are adjustable in position to improve the safety and comfort of the user.

A wheelchair seat is typically comprised of an upright seat back portion and a generally horizontal seat portion, which in the usual position form approximately a 900° angle therebetween. The seat frame, comprising the seat back and seat, is usually attached to the wheelchair platform. There are two main types of position of adjustment that can be made to seats, namely, tilt and recline. In a tilt system, the seat back portion and the seat portion remain in a fixed angular relation to one another through a change of angle of the seat frame. Therefore, as the seat back is tilted down at the back, the seat portion is tilted up at the front. In a recline adjustment, the angle between the seat back and the seat changes so that as the seat back portion is reclined, the seat portion remains generally horizontal.

Ideally a seat on a wheelchair platform will be located such that it won't compromise the stability of the wheelchair, typically with the user's center of gravity located between the front and rear wheels of the wheelchair. A problem exists with shorter wheelbase wheelchairs when the position of the user is changed relative to the base through seat adjustment. For example, when tilting, the center of gravity of the user will move rearwardly as the seat tilts back. This can lead to an overbalancing of the wheelchair and a dangerous situation for the occupant. Therefore, the prior art discloses examples of center of gravity compensation mechanisms for tilt systems. An example of such a system is U.S. Pat. No. 5,044,647 entitled Stabilized Reclining System. In this system, as the seat tilts, the seat back and seat portion assembly moves forward. This is accomplished by means of a pivot point sliding in a cam. Note that while the title of the invention uses the term "recline" all that is taught is a tilt system. This prior invention does not teach any structure to allow the seat back angle to change relative to the seat, with the seat remaining essentially horizontal, as is usually the case for reclining, because the seat and seat back are connected by a substantially rigid connection.

The same problem of the center of gravity changing as the position of the user changes on the wheelchair exists with recline systems, and various attempts have been made in the past to change the position of the user during recline. However, all of these prior systems teach a need to change the elevation of the seat portion and occupant through the recline. This requires complicated link element structures, and makes it more difficult to adjust the position of the seat since in addition to reclining, lifting or the like is required. Further, the structures proposed include multiple link assemblies which are less stable than what is desirable. An example of such a device is found in U.K. Patent Application 2,136,742 to Waite. Other examples of various prior art recline systems include U.S. Pat. No. 5,333,887 to Luther, U.K. Patent Application 2,101,884 to Williams, and U.S. Pat. No. 5,050,899 to Stensby. Other examples of various structures are shown in the following patents:

U.S. Pat. No. 5,853,059 to Goertzen et al.;
U.S. Pat. No. 5,312,153 to Lin;
U.S. Pat. No. 5,154,438 to Barclay;
U.S. Pat. No. 5,108,148 to Henke;
U.S. Pat. No. 5,064,211 to Huttenhuis et al.;
U.S. Pat. No. 5,044,647 to Patterson;
U.S. Pat. No. 4,834,411 to Willey et al.;
U.S. Pat. No. 4,759,561 to Janssen;
U.S. Pat. No. 4,591,182 to Wood;
U.S. Pat. No. 4,346,933 to Jacobs; and
U.S. Pat. No. 3,179,466 to Garrett.

SUMMARY OF THE INVENTION

What is desired is a reclining wheelchair which can simply, easily and reliably compensate for changes of position of an occupant's center of gravity during changes in the position of the seat assembly on the wheelchair platform without changing the elevation of the seat. It is preferred if such a system is a power actuated system and therefore is operable by a disabled person capable only of minor manipulation of motor controls. Ideally such a system would be simple to implement and could be added to any existing power wheelchair platform. Preferably the system would be robust and strong enough to take user and attendant induced stresses and strains without fear of breakage. Lastly, the design should be relatively simple and inexpensive to make.

Therefore, according to the present invention there is provided a kit for adding a reclining seat to a wheelchair, the wheelchair having a base platform with sufficient ground engaging wheels rotatably connected to said base platform to permit said wheelchair to be wheeled along a surface, said kit comprising:

a stationary seat frame for mounting to said base platform;

a seat for mounting to said stationary seat frame, said seat having a seat portion and a back portion pivotally mounted to said seat portion, and an actuator operatively connected to said seat for causing said back portion of said seat to change angle;

a sliding connector for slidably mounting said seat portion to said stationary seat frame; and means for sliding said seat on said stationary seat frame along said sliding connector without changing height as actuator causes said angle of said back portion to change wherein said kit, when mounted on a wheelchair, compensates for a change in an occupant's center of gravity as said back portion changes angle by sliding said seat portion on said stationary seat frame.

According to another aspect of the present invention there is provided a wheelchair comprising:

a base platform;

a sufficient number of ground engaging wheels rotatably attached to said base platform to permit said wheelchair to be wheeled along a surface, a seat mounted on said base platform and having a seat portion and a back portion pivotally attached to said seat portion; and a recline mechanism operatively connected between the base platform and the seat, the recline mechanism including an adjustable length actuator to cause said seat back portion to change angle, a slidable connection between said seat and said base platform to permit said seat to slide on said base platform without changing height and at least one link element pivotally connected between said seat back portion and said base platform for sliding said seat on said base platform as said angle of said back portion changes, wherein said wheelchair compensates for a change in an occupant's center of gravity as said seat back portion changes angle.

BRIEF DESCRIPTION OF THE DRAWINGS

The present invention will now be described, by way of example only, by making reference to the following drawings in which.

DETAILED DESCRIPTION OF THE PREFERRED EMBODIMENTS

Figure 1:
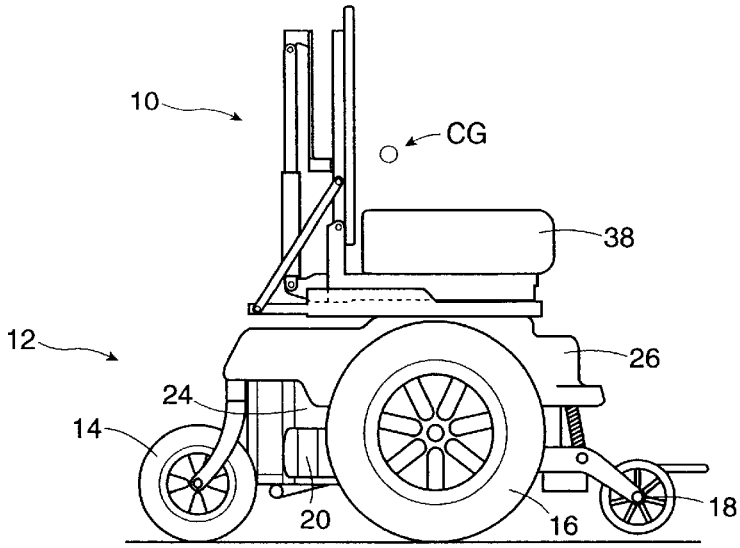
FIG. 1 illustrates a wheelchair modified by a kit for adding a reclining seat to a wheelchair according to the present invention, where the kit is in an upright position.
Figure 2:
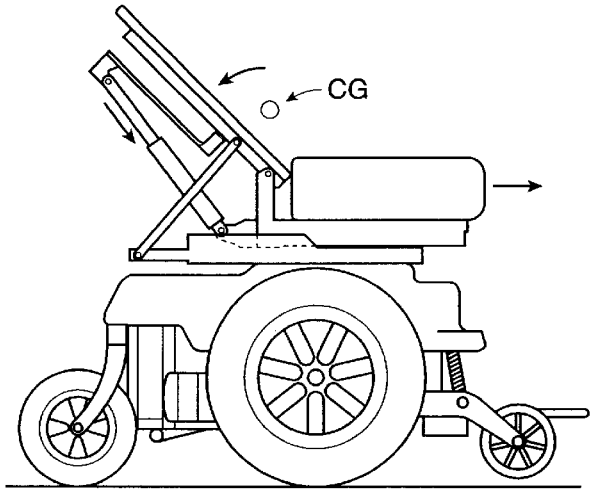
FIG. 2 shows the invention of FIG. 1, where the kit is in a semi-reclined position.
Figure 3:
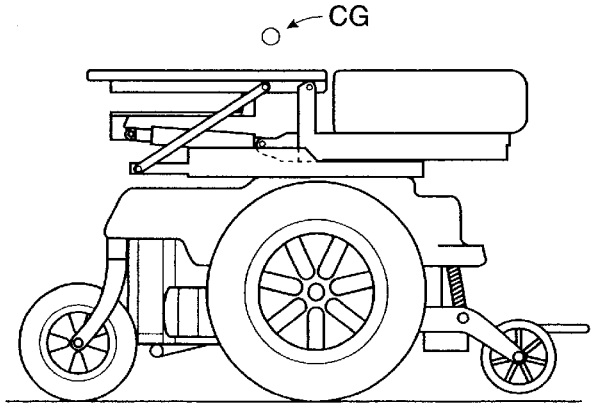
FIG. 3 shows the invention of FIGS. 1 and 2, where the kit is in a fully reclined position.

FIG. 1 shows a wheelchair base having a reclining seat assembly kit 10 added according to the present invention.

It will be appreciated by those skilled in the art that the present invention can be used in association with many types of wheelchair platforms or bases. These would include front, mid, or rear drive wheelchairs with front or rear caster wheels or both, as well as other powered and non-powered platforms. For ease of reference, the present invention is illustrated in association with a particular platform of the sort identified in U.S. Pat. No. 5,944,131. This platform is provided for illustration purposes only and the present invention may be applied to many other types of platforms as well. Further, while the present invention is complementary to a shorter wheelbase platform such as illustrated, the adjustable seat kit of the present invention may be advantageously used on many different types of wheelchair base or platform.

The wheelchair platform or base is indicated generally as 12 and includes a rear pivoting or caster wheel 14, a main drive wheel 16 and a front anti-tip wheel 18. While only one of each is shown, it will be appreciated that the same wheels 14, 16 and 18 are presented on the opposite side of the wheelchair platform 12. The platform 12 includes drive motors 20 for each drive wheel 16 powered by batteries located in a battery box 24. The wheelchair base may also include a cowl 26 which acts as a decorative and protective cover for the powered wheelchair platform 12.

A reclining seat assembly kit 10 according to the present invention is shown resting on the base 12. The kit 10 is supported by means of seat or post supports 28 which extend below the seat and may be fixed to the platform such as by bolts or the like. As set out in more detail below, to adapt the present invention to other types of wheelchair platforms, all that is required, is to locate the supports 28 of the present invention to adequately interface with the corresponding support structures of different types of platforms. However, the present invention is illustrated in association with the described platform since reasonable results have been attained with this type of short wheelbase platform.

Figure 4:
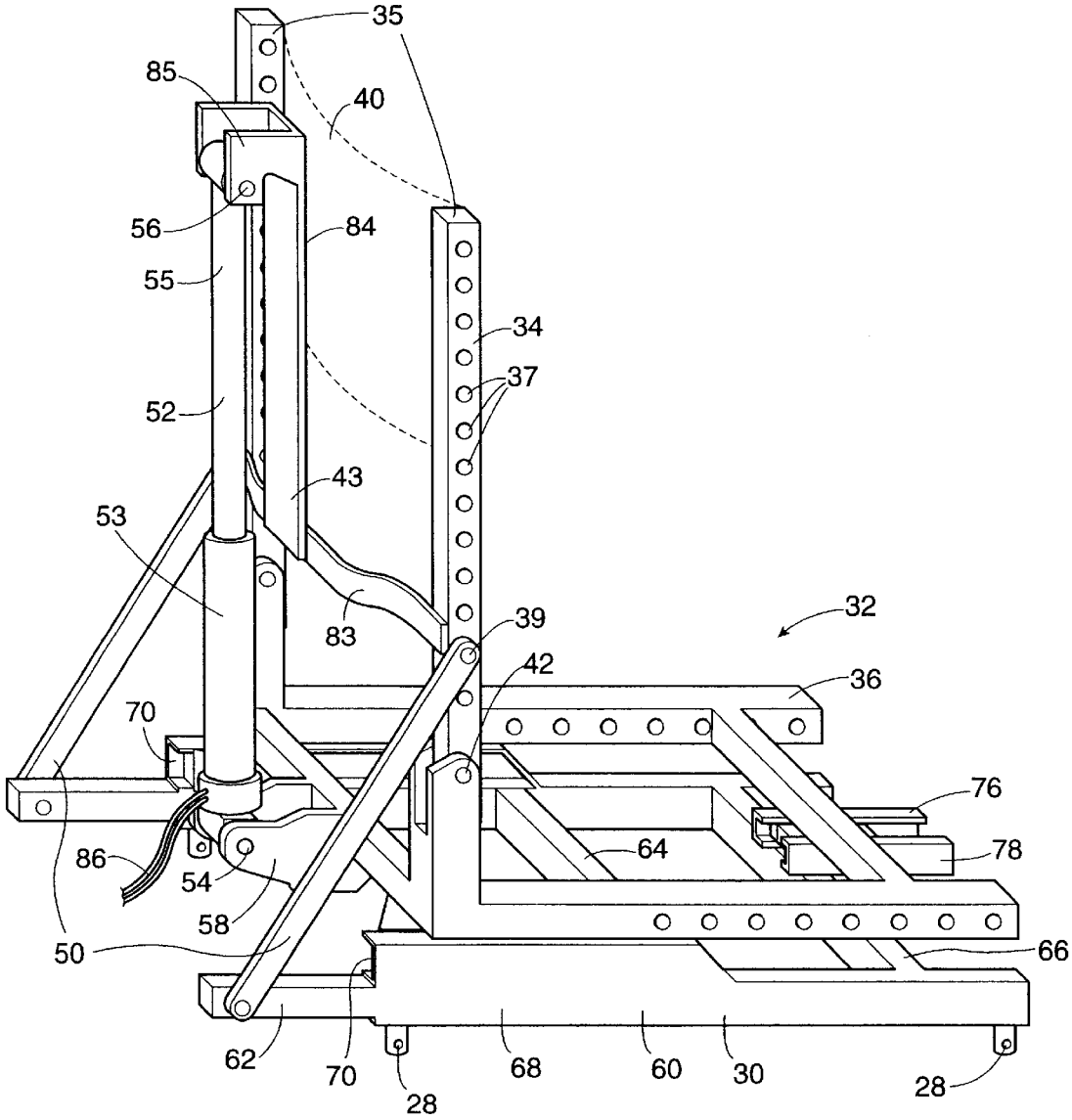
FIG. 4 shows the structural elements of the invention of FIGS. 1 to 3 without the seat cushions or the wheelchair platform.

Turning now to the components of the present invention, as illustrated in FIG. 4, there is provided a stationary seat frame 30 upon which sits a movable frame 32. The movable or sliding frame 32 is comprised of a seat back portion 34 and a seat portion 36. The seat back portion includes side frame elements 35, which have a plurality of apertures 37. The seat portion 36 typically carries a cushion 38 as shown as shown in FIG. 1. A cushion (not shown) may also be provided to the seat back portion 34 if desired. Alternately, the seat back portion may be provided only with a thin sling back 40 as illustrated.

The seat back portion 34 is pivotally attached to the seat portion 36 at pivotal connection 42, which is positioned a certain vertical distance above the seat 36. The side frame elements 35 are attached to a central T-shaped element 43, which is explained in more detail below. The T-shaped element is most preferably welded to the side frame elements 35 as shown, but it will be appreciated by those skilled in the art that other forms of attachment may also be used such as screws bolts or the like. What is desired is to form a rigid frame which is strong enough to carry the required loads induced by disabled persons and attendants without failing.

Operatively connected between the stationary frame 30 and the movable frame 32 is a recline mechanism which is explained in more detail below. The recline mechanism includes a means for sliding the seat portion 36 along the stationary seat frame 30. In the preferred form the means for sliding comprises a pair of rigid link elements 50 extending between the stationary frame 30 and the seat back portion 34, with one link element 50 located on either side of the wheelchair. Each link element 50 is pivotally attached at both ends to one of the apertures 37 in side frame element 35.

In FIG. 4, link element 50 is shown connecting with side frame element 35 at pivotal connection 39, Which happens to be the second of the apertures 37 from the bottom. In this position the seat back 34 is upright, i.e. in the conventional chair position where it is perpendicular to the seat 36. It can be appreciated that pivotal connection 39 can be selectively connected with any of the apertures 37, and that as the pivotal connection is made further along side frame element 35, there will be a gradually increasing and predetermined angle of recline established in seat back 34, corresponding to kit 10 being in its "upright" position (i.e. the position shown in FIG. 1). It will be appreciated that the present invention comprehends other types of adjustable connection such as a continuous slot with a locking mechanism, a channel with a similar mechanism or sliding clamp. It will also be appreciated that any such change in initial position or angle will likely change the travel of the seat portion during recline, which may require other adjustments, such as to the link elements.

Further, while good results have been achieved with rigid link elements, as disclosed other mechanical structures are comprehended by the present invention, provided that such structure causes the seat portion to slide forward as the seat back reclines, and to slide backward as the seat back is raised, whereby the position of the disabled person is adjusted to stabilize a center of gravity over the wheelchair platform.

Also extending between the seat portion 36 and the seat back 34 and forming part of the recline mechanism is an actuator 52. The actuator 52 is pivotally attached at pivotal connections 54 and 56 as shown. The pivotal connection 54 is made in a bracket 58 extending back from the seat portion 36, which may be referred to as a lower support bracket. The pivotal attachment 56 is made to a top of the T-shaped bracket 43, which is part of the seat back portion 34.

As shown, the stationary frame 30 includes a series of seat posts 28 which permit the seat assembly to be secured to the wheelchair platform 12. The stationary frame further includes side elements 60 with rear extension 62. Cross members 64 and 66 are also provided to hold the stationary frame 30 together. Again the preferred from of assembly is welding, but other methods of attachment are also comprehended by the present invention. Also shown is a built up channel section 68 as described in detail below. It will be appreciated that other frame configurations are possible provided they provide sufficient support to support the members as needed.

The seat portion 36 is connected to the stationary frame 30 in a particular manner. More particularly, a sliding connection is provided which permits the seat portion to move back and forth relative to the stationary frame 30 without changing elevation. In the preferred form of the invention as illustrated, rear guide rails 70 are provided in the built up channel section 68 on the stationary frame 30. The guide rails 70 form a trap or guide within which a glide (not shown) attached to the seat portion is mounted.

Figure 5:
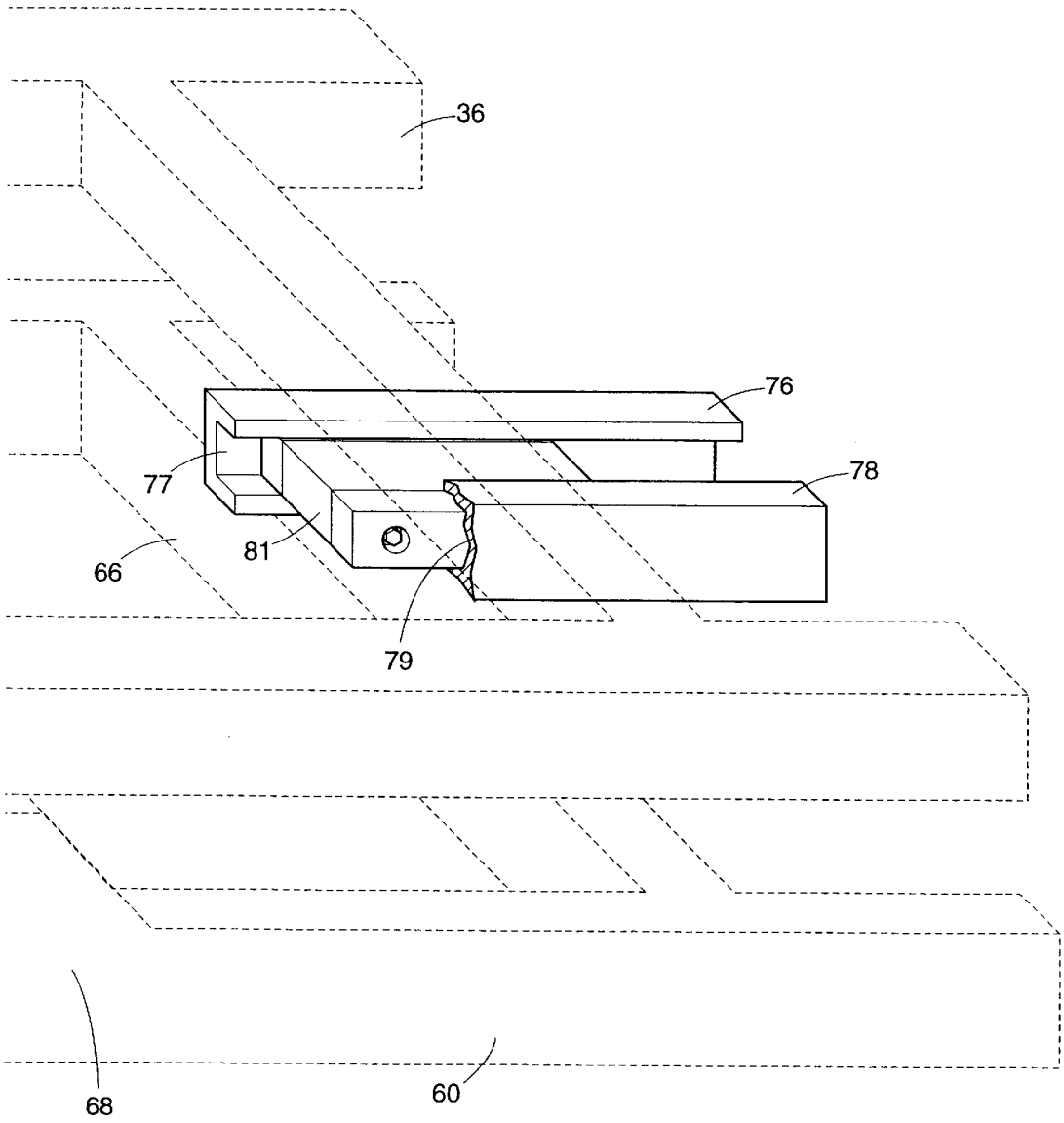
FIG. 5 is a detailed view of an element of FIG. 4.

Turning to the front of the stationary portion, as shown in detail in FIG. 5, a pair of opposed front guides 76, 78 are provided generally centrally located on the stationary frame 30. The front guides define channels 77 and 79 within which front glides 81 can slide. The front glides are also preferably low friction plastic glides. In this manner, the seat portion is slidably retained on the stationary frame portion which permits the movement of the seat portion relative to the stationary frame portion without changing the height of the seat portion. Low friction plastic glides made from NYLON or TEFLON (™ of Dupont) have been found to provide an adequate sliding action although the present invention also comprehends bearings, rollers or other such devices.

As can be seen in FIG. 4, the pivot point 42 between the seat portion 36 and the seat back 34 is raised above the elevation of a plane of the stationary seat frame 30. For comfort, the elevation of the pivot point is most preferably slightly above the level of a top of the seat cushion 38 provided on the seat portion 36 for the reasons explained below.

Also shown is an actuator 52 which is pivotally attached at one end to a lower support bracket 58 which extends rearwardly from the sliding seat portion 36. The actuator 52 is shown as having a housing 53 and a shaft portion 55, which fits and slides within the fixed portion 53. In this embodiment both portions are cylindrical in shape. The bracket 58 in the preferred embodiment is mounted to the sliding seat portion 36 but could be mounted elsewhere. It will be understood that the primary function of the actuator is to cause a change in angle between the seat portion and the seat back and so any mounting that accomplishes this is to be comprehended by the present invention.

It can now be appreciated that the other end of the actuator 52, being the end of sliding portion 55, is pivotally attached to the upside down T-shaped bracket 43. The bracket 43 is configured to also provide additional comfort to the occupant. Although the bracket 43 could be attached across the top of the rear portion of the seat back it is common for occupants of wheelchairs to adjust their position by hooking an arm over either lateral side frame element of the seat back portion. Thus, by providing a bracket in the form of an upside down T with a horizontal portion 83 as shown below an upright central portion 84, users are free to hook their arms over the posts without interference from the bracket. Most preferably an actuator coupler 85 is provided in the form of a pair of opposed openings. The openings are formed in the upright portion 84, distal from cross member or horizontal portion 83. A bolt is secured in the openings to which the actuator is in turn coupled. It will be appreciated by those skilled in the art that other shapes for the upside down T-bracket 43 are possible, provided that the bracket is rigidly fixed to the frame of the seat back portion 34 and provides an appropriate actuator coupler 85 clear of the side frame elements 35.

The preferred form of actuator 52 is a linear actuator which can be powered from the electrical power supply located in a conventional wheelchair battery power pack. In this way the actuator may be made easily operable and integrated into the onboard power system. Typically the actuator will be electrically connected to a power control device located within reach of the user or occupant of the wheelchair. In this way, the actuator can be activated by the user and the position of the user changed at will.

The actuator 52 may be any conventional mechanical, hydraulic or pneumatic actuator which has the load capabilities desired for the typical range of loads encountered in this operation. Ideally the actuator will have a capability of about 500 lbs. This could be made greater, if heavier loads are likely. Control wires 86 are shown leading away from the actuator and would be connected to the source of power, such as the battery contained in the platform and to a power control device (not shown).

The actuator 52 may be any mechanical device which changes length by extending and retracting. It is preferably a powered mechanical device, and is most preferably powered by the electric power available in a typical powered wheelchair platform. It will be appreciated that a hydraulic system may be utilized, but a screw type linear actuator is preferred.

The design of the actuator 52, and in particular the sliding portion 55, is related to certain other dimensions of the reclining seat assembly kit 10. The preferred vertical distance of the pivotal connection 42 above the plane of the seat 36 is between about 2 inches and 4 inches with 3 inches being the most preferred. The preferred horizontal distance between the pivotal connection 54 of the lower support bracket 58 and the seat 36 is about 3 to 7 inches with 5 inches being most preferred. Thus the preferred range of travel for the sliding portion 55 of the actuator 52 is about 5 to 7 inches. Of course it will be appreciated that the change in center of gravity will vary for each wheelchair user and will :depend upon their unique size and weight distribution on their frame. However, good results have been achieved over a range of users with about 5 to 7 inches of horizontal travel of the seat portion between the upright and fully reclined seat back positions.

The operation of a wheelchair including the present invention can now be more fully understood. When the seat back is in the upright position, the seat is positioned over the wheels to provide stability. This is done locating the seat relative to the wheels so that an occupant's center of gravity is located between the main drive wheels and the rear caster wheels. As can be seen in FIG. 1, the center of gravity (CG) of an occupant is located generally between the drive wheels and the caster wheels, but closer to the drive wheels.

In the event that the user wishes to change the angle of the seat back, the user merely adjusts a control device such as a joy stick to cause the actuator to be energized, which causes the actuator to change length. As the actuator changes length the seat back changes angle relative to the seat portion. As the angle changes, the link element causes the seat and seat back to change position relative to said base or platform. In the event the seat back is being lowered, in the absence of the present invention, the center of gravity of the occupant would move back creating the possibility of an unbalanced or tippy weight position. However, as can be appreciated from the foregoing description in the present invention the link element 50 causes the seat portion to slide forward on the sliding connection. In other words the glides slide in the guides to allow the position of the seat to change on the stationary frame as the actuator changes length. Thus as the angle of incline of the seat back decreases the seat is smoothly and gradually thrust forward. This has the effect of moving the center of gravity forward from where it would be without the present invention.

It will be appreciated that the present invention is sized and shaped to permit the center of gravity to maintain its preferred position by essentially moving the seat forward and approximately at the same rate as the center of gravity is moved backward by reason of the change of angle alone. Any horizontal movement of the center of gravity CG is less than 20 percent, preferably less than 15 percent, and more preferably less than 10 percent of the total horizontal distance spanned by the sliding of the seat 36. In this way the present invention compensates for a change in a position of center of gravity during recline and permits the occupant to be securely balanced over the weight bearing portion, of the wheelchair at the start of the recline, during recline and even when fully reclined.

As will be appreciated from the foregoing description, as the wheelchair seat back is raised the reverse is true and the center of gravity of the occupant will be gradually moved forward as the person assumes a more upright position. The present invention smoothly and gradually returns the seat to its rearward position as the seat back is raised and so compensates for the change in position of a person causing the center of gravity to change position.

Figure 6:
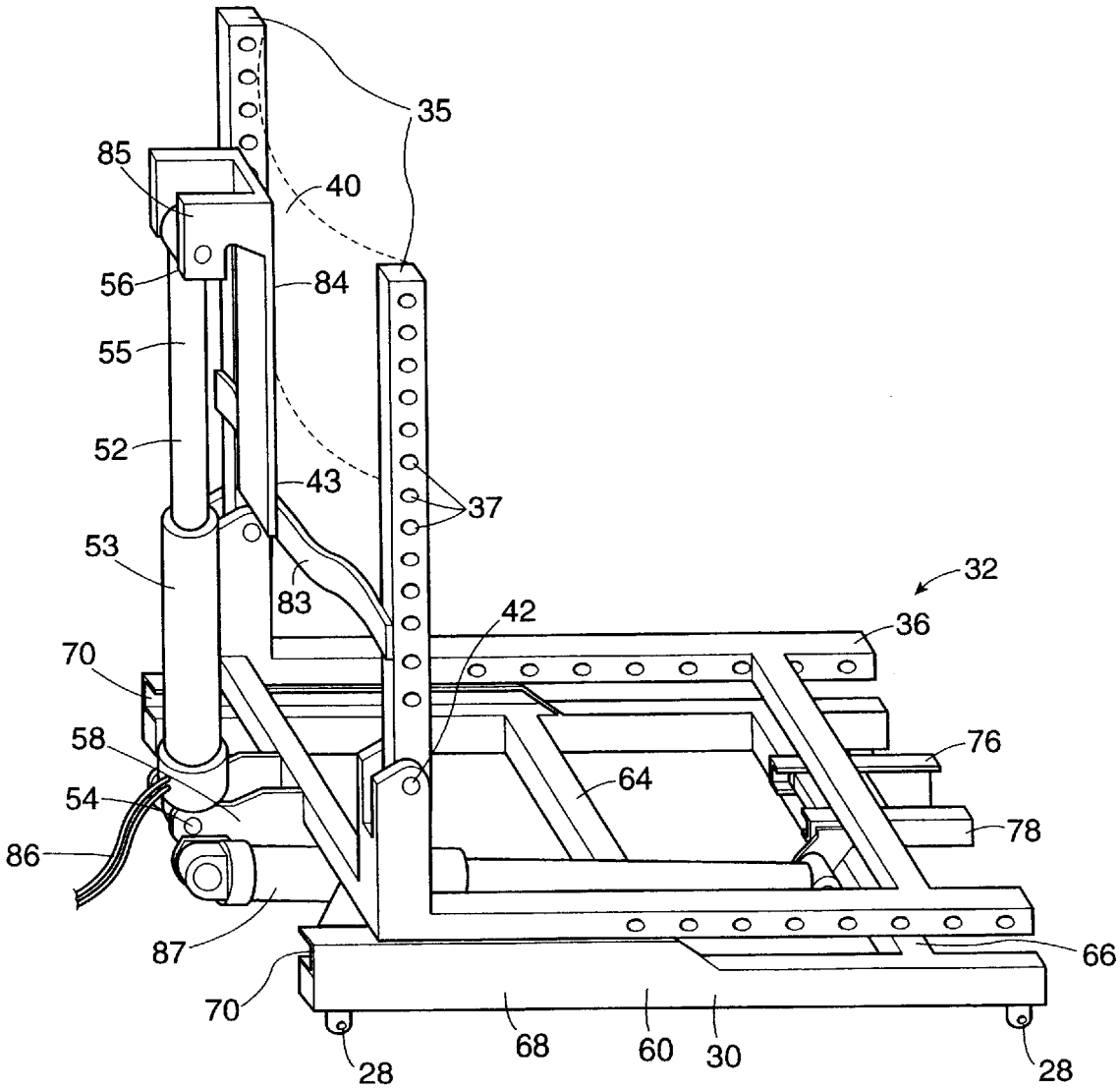
FIG. 6 shows the structural elements of an embodiment of the invention that uses a second actuator rather than rigid link elements.

In a further embodiment, as shown in FIG. 6, instead of rigid link elements 50 the means for sliding may comprise a second actuator 87 connected between the movable frame 32 and the stationary frame 30. Said actuator could attach for example between the bracket 58 of the movable frame 32, and the cross member 66 at the front of the stationary frame 30. Since the rigid link elements 50 are removed, in this embodiment the stationary frame 30 would not require the rear extension 62. This embodiment may therefore be more suitable for shorter wheelchairs that lack the depth to accommodate the rear extension 62. In operation, activation of the second actuator 87 would cause the seat to slide forward and backward. Further, activation of the second actuator 87 could be coupled with activation of the seat-back actuator 52. Thus, the speed and the distance to which the seat moves relative to a given degree of recline could be adjusted to reflect the specific needs of the user, all while continuing to allow for center of gravity compensation. The relative movement of the actuators could be pre-set to an appropriate setting, with provision for further adjustments by the user.

It will be appreciated by those skilled in the art that various modifications can be made to the form of the present invention without departing from the scope of the claims or the spirit of the invention. Some of these variations have been discussed above and others will be apparent to those skilled in the art. For example, while the invention has been described as having the actuator extend between the seat back portion and the seat, it could also extend between the seat portion and the stationary frame, or both.

We claim:

1. A kit for adding a reclining seat to a wheelchair, the wheelchair having a base platform with sufficient ground engaging wheels rotatably connected to said base platform to permit said wheelchair to be wheeled along a surface, said kit comprising:

a stationary seat frame for mounting to said base platform;

a seat for mounting to said stationary seat frame, said seat having a seat portion and a back portion, said back portion pivotally mounted to said seat portion, and an actuator operatively connected to said seat for causing said back portion of said seat to change angle;

a sliding connector for slidably mounting said seat portion to said stationary seat frame; and means for sliding said seat on said stationary seat frame along said sliding connector without changing the height of said seat portion relative to said stationary seat frame as said actuator causes the angle of said back portion to change;

wherein said kit, when mounted on the wheelchair, compensates for a change in an occupant's center of gravity by sliding said seat portion forward on said stationary seat frame as said back portion changes angle relative to said seat portion.

2. A kit for adding a reclining seat to a wheelchair as claimed in claim 1 wherein said means for sliding comprises a second actuator connected between said seat and said stationary seat frame.

3. A kit. for adding a reclining seat to a wheelchair as claimed in claim 1 further including two link elements, each of said link elements extending between said back portion and said stationary seat frame.

4. A kit for adding a reclining seat to a wheelchair as claimed in claim 1 wherein said stationary seat frame is sized and shaped to mount onto a standard base frame of said wheelchair.

5. A kit for adding a reclining seat to a wheelchair as claimed in claim 1 wherein said actuator is mounted between said seat portion and said back portion.

6. A kit for adding a reclining seat to a wheelchair as claimed in claim 1 wherein said actuator is a power actuator remotely operable by an occupant of said wheelchair.

7. A kit for adding a reclining seat to a wheelchair as claimed in claim 1 wherein said seat portion includes a support bracket extending rearwardly to which said actuator is pivotally mounted.

8. A kit for adding a reclining seat to a wheelchair as claimed in claim 1 wherein said pivot point of said back portion is raised by a predetermined amount above a plane defined by said seat portion.

9. A kit for adding a reclining seat to a wheelchair as claimed in claim 8 wherein said predetermined amount is generally the same as a thickness of a seat cushion placed on said seat portion, wherein at full recline of said back portion, said back portion lies generally in the same plane as a top surface of said cushion on said seat portion.

10. A kit for adding a reclining seat to a wheelchair as claimed in claim 1 wherein said sliding connector comprises at least one guide member mounted on one of said seat portion and said stationary frame and at least one track member mounted to the other of said stationary frame and said seat portion, wherein said guide member and said track member are operatively engaged to permit said guide member to move along said track member.

11. A kit for adding a reclining seat to a wheelchair as claimed in claim 10 wherein one of said guide member and said track member include means for reducing friction.

12. A kit for adding a reclining seat to a wheelchair as claimed in claim 11 wherein said means for reducing friction comprises said guide member being formed from a low friction material.

13. A kit for adding a reclining seat to a wheelchair as claimed in claim 10 wherein said seat portion is guided by both a front and a back guide member and track member.

14. A kit for adding a reclining seat to a wheelchair as claimed in claim 12 further including at least three track members, one on each side at the rear of said seat and at least one at the front in the middle, wherein said kit provides room beneath a front of said stationary frame portion for movable leg rest mechanisms.

15. A kit for adding a reclining seat to a wheelchair as claimed in claim 7 wherein said actuator is pivotally attached at one end to said seat back and is further pivotally attached at the other end at said support bracket.

16. A kit for adding a reclining seat to a wheelchair as claimed in claim 15 wherein said actuator has a length of travel approximately equal to the height of said pivot point of said back portion above the frame and the distance of said rearward displacement of said pivotal attachment of said actuator from said back portion.

17. A kit for adding a reclining seat to a wheelchair as claimed in claim 1 wherein said actuator is attached to said back portion by means of an extension bracket which permits a top of said back to be free of horizontal frame elements.

* * * * *